US005353532A

United States Patent [19]

Lysenko et al.

[11] Patent Number: 5,353,532

[45] Date of Patent: Oct. 11, 1994

[54] TOOTH OF ACTIVE-ACTION EXCAVATOR BUCKET

[75] Inventors: Leonid L. Lysenko; Alfred R. Mattis; Sergei V. Shishaev, all of Novosibirsk; Genrikh K. Boiko, Ekaterinburg; Alexandr V. Tolmachev, Ekaterinburg; Vladimir N. Tsvetkov, Ekaterinburg; Mikhail S. Druzhinin, Novosibirsk, all of Russian Federation

[73] Assignees: Institut Gornogo Dela Sibirskogo Otdelenia Rossiiskoi Akademii Nauk, Novosibirks, Russian Federation; Proizvodstvennoe Obiedinenie "Uralmash", Ekaterinburg, both of

[21] Appl. No.: 902,918

[22] Filed: Jun. 23, 1992

[30] Foreign Application Priority Data

Jun. 19, 1991 [SU] U.S.S.R. ..... 4942600
Jun. 19, 1991 [SU] U.S.S.R. ..... 4942601

[51] Int. Cl.[5] ..... E02F 5/00

[52] U.S. Cl. ..... 37/447; 37/904; 172/101

[58] Field of Search ..... 37/141 R, 141 T, 142 R, 37/142 A, 117.5, DIG. 18, DIG. 3, DIG. 12, 103, 80 A; 172/82, 101, 699

[56] References Cited

U.S. PATENT DOCUMENTS

| | | | |
|---|---|---|---|
| 4,930,584 | 6/1990 | Ching et al. | 37/DIG. 18 X |
| 4,959,915 | 10/1990 | Roussin et al. | 37/DIG. 18 X |
| 4,984,850 | 1/1991 | Jensen | 37/DIG. 18 X |
| 5,094,017 | 3/1992 | Matsumoto et al. | 37/117.5 X |

FOREIGN PATENT DOCUMENTS

| | | | |
|---|---|---|---|
| 257541 | 11/1986 | Japan | 37/117.5 |
| 810909 | 3/1981 | U.S.S.R. | 37/DIG. 18 |
| 848545 | 7/1981 | U.S.S.R. | 37/DIG. 18 |
| 883285 | 11/1981 | U.S.S.R. . | |
| 1509524 | 9/1989 | U.S.S.R. . | |

*Primary Examiner*—Randolph A. Reese
*Assistant Examiner*—Spencer Warnick
*Attorney, Agent, or Firm*—Ladas & Parry

[57] ABSTRACT

A characteristic feature of the present invention is that a damping unit is provided between the casing, impact tool and elements of a pneumatic hammer. The damping unit may have a different design.

10 Claims, 2 Drawing Sheets

TOOTH OF ACTIVE-ACTION EXCAVATOR BUCKET

FIELD OF THE INVENTION

The present invention relates to building machinery and, more particularly, the invention relates to a tooth of an excavator bucket intended for breaking rock and frozen ground without preliminary loosening.

PRIOR ART

Known in the art is machinery for development or breaking rooks having different mineralogical composition with or without preliminary loosening. One of such impact-action devices comprises a housing accommodating a reciprocating striker interacting with a working tool. The device also has an automatic starting mechanism and an air distributor. The use of such a construction allows one to eliminate a possibility of putting the device into operation when a temporary load is applied to the working tool, because the automatic starter has no time to start its operation. However, in the process of operation, when a cavity is formed under the working tool, the latter moves forward drastically and the impact loads are taken by the bushing causing its destruction. This considerably reduces the reliability and longevity of the device.

Well known in the art is an excavator bucket comprising a front wall, a rear wall, and a bottom. The front wall accommodates tubular casings with holes in the bottom. The holes are closed by fixing locks in which air passages are formed. The device also has pneumatic hammers and impact teeth. In this device, the front part of the casing is made in the form of a truncated cone with a smooth transition to the teeth. The tail of the impact teeth is installed in the front portion of the tubular casing and is fixed in a preset position by means of keys. Such a design of the bucket makes it possible to reduce the resistance to its filling with rock.

However, in the process of operation the rigid keys subjected to impact loads quickly become unfit for further use thus considerably reducing the operational reliability of the entire device. Furthermore, at the points of contact of the keys with the box, swellings of metal occur so that an undetachable joint is formed and the box bushings cannot be replaced.

A better construction is an excavator bucket tooth (SU, A, 883285) including a tubular casing accommodating a pneumatic hammer and a mechanism for automatic start of the pneumatic hammer comprising a housing made in the form of cover and a locking ring, and a piston. Installed between the housing and the piston is a spring. Such a design of the tooth of the excavator bucket provides guaranteed disconnection of the pneumatic hammer regardless of the compressed air pressure and excludes a possibility of its idle operation without offering resistance to digging on the tooth.

However, mutual motion of the pneumatic hammer and the tooth relative to each other and the casing are unlimited. Under the effect of pressure the pneumatic hammer moves backwards and applies pressure onto the piston of the automatic starting mechanism. In so doing, the pressure on the piston is not limited and can overcome the preset force of switching on the automatic starting mechanism. In this case the excavator digging forces are resisted by the housing through the piston end face. Therefore, when the bucket meets hard rock, the high loads on the piston and housing drastically reduce the reliability and longevity of the automatic starting mechanism and, consequently, of the bucket as a whole. When cavities are formed in the rock in front of the tool, the tooth and sleeve of the pneumatic hammer can overhang because their mutual motion relative to the casing is not limited.

The closest in the technical essence to the proposed invention is a device (SU, A, 1509524) comprising a hollow casing accommodating an impact tool and a pneumatic hammer with an automatic starting mechanism, both members being capable of moving in an axial direction. Also arranged inside the casing is a compressed air pilot-valve distributor. The automatic starting mechanism includes a pusher and an air valve disposed in the pusher guides, and a piston with a cup capable of interacting with the air valve, all the above-mentioned components being rigidly connected to the pneumatic hammer stem. Installed at the end faces of the piston and cup is a thrust disk spring-loaded by means of elastic members whose total force is at least 1.5 times the weight of the movable parts of the pneumatic hammer. Such a design makes it possible to eliminate the operation of the pneumatic hammer at low digging efforts. In this case, the bucket operates in an ordinary manner and the pneumatic hammer service life is increased.

However, this device, like those described above, is insufficiently reliable in operation since, when breaking weak rock with the resistance to the penetration of the tool being low, a part of the kinetic energy of the striker is damped by the pneumatic hammer bushing, this causing bending stresses and leading to its destruction.

SUMMARY OF THE INVENTION

The basic object of the invention is to provide an excavator bucket tooth of an improved design.

Another object of the invention is to improve the elements of the pneumatic hammer Still another object of the invention is to reduce the loads on the internal components of the pneumatic hammer and to increase the operational life of the excavator bucket.

Yet another object of the invention is to simplify the construction as a whole and to provide convenient service of the device.

This and other objects of the invention are attained due to the fact that the tooth of an excavator bucket comprising a hollow casing accommodating an impact tool and a pneumatic hammer adapted for moving in an axial direction, the pneumatic hammer being linked with automatic starting mechanism including a housing and a piston, according to the invention, has a damping mechanism located between the casing, impact tool and the pneumatic hammer elements.

In one embodiment of the invention the damping unit is made in the form of keys limiting the mutual motion of the pneumatic hammer and the impact tool relative to each other and to the casing, said tool having a through slot to pass the keys.

It is advisable that the key slot length satisfy the relation $L=B-x-c+2l+b$, where L is the key slot length; B is the gap between the housing and the piston of the automatic starting mechanism when the pneumatic hammer is off: l is the length of penetration of the tool into rock per stroke; c is the distance passed by the tool backwards when the pneumatic hammer is energized; x is the minimum admissible gap between the housing and the piston of the automatic starting mechanism; b is the key width.

It is expedient that the key is made in the form of two rigid members with an elastic insert between them. An annular groove must be made at the place of disposition of the key slot.

In another embodiment of the invention the damping unit is made in the form of a bushing consisting of two parts installed with an axial gap and interconnected through an elastic member.

The casing is preferably made with a flange. The inner diameter of the flange is preferably defined by the relation $D_1=2r$, where $D_1$ is the inner diameter of the bushing; r is the radius of joining of the inner diameter of the bushing with its end face.

Such a design of the device considerably increases its reliability and longevity is in process of breaking stony rock and monoliths.

The essence of the invention consists in the following. In order to avoid impacts of the piston end face against the automatic starting mechanism, when the tooth meets hard rock, as well as overhang of the impact tool from the pneumatic hammer bushing in the case of cavities in the rock in front of the tooth, it is necessary to install an attachment (damping unit) in the device to smooth out the dynamic loads appearing during the operation.

Such a damping unit can be made in different ways. For example, if the unit is a combination of keys, they make it possible to limit the mutual motion of the impact tool and pneumatic hammer relative to each other and relative to the casing. The impact tool has a through slot to pass said keys, the length of this slot being selected from the relation $L=B-x-c+2l+b$. This makes it possible to limit the mutual displacements of the tool and pneumatic hammer for a value necessary to eliminate a possibility of collision of the piston end face with the housing of the automatic starting mechanism and overhang of the tail of the impact tool from the bushing and sufficient for switching the pneumatic hammer for imbedding the impact tool into the rock. The embodiment of each key in the form of two rigid members with an elastic insert between them increases the life of such keys.

Provision of an annular groove near the key slot excludes a possibility of appearance of plastic deformation of metal forming an undetachable joint.

The function of limiting the loads onto the internal parts of the pneumatic hammer is performed by a damping unit made as a bushing of two parts installed with an axial gap between them and interconnected through an elastic member.

In order to provide optimum loading of such a bushing the casing has a flange whose inner diameter is selected from a relation $D1+2r$.

Therefore, the above-mentioned design features of the device make it possible to increase its reliability and, in particular, to increase it pneumatic hammer serive life by 10–15%.

BRIEF DESCRIPTION OF THE DRAWINGS

For better understanding of the invention, it is illustrated by the appended drawings, in which.

DETAILED DESCRIPTION OF PREFERRED EMBODIMENTS OF THE INVENTION

Figure 1:
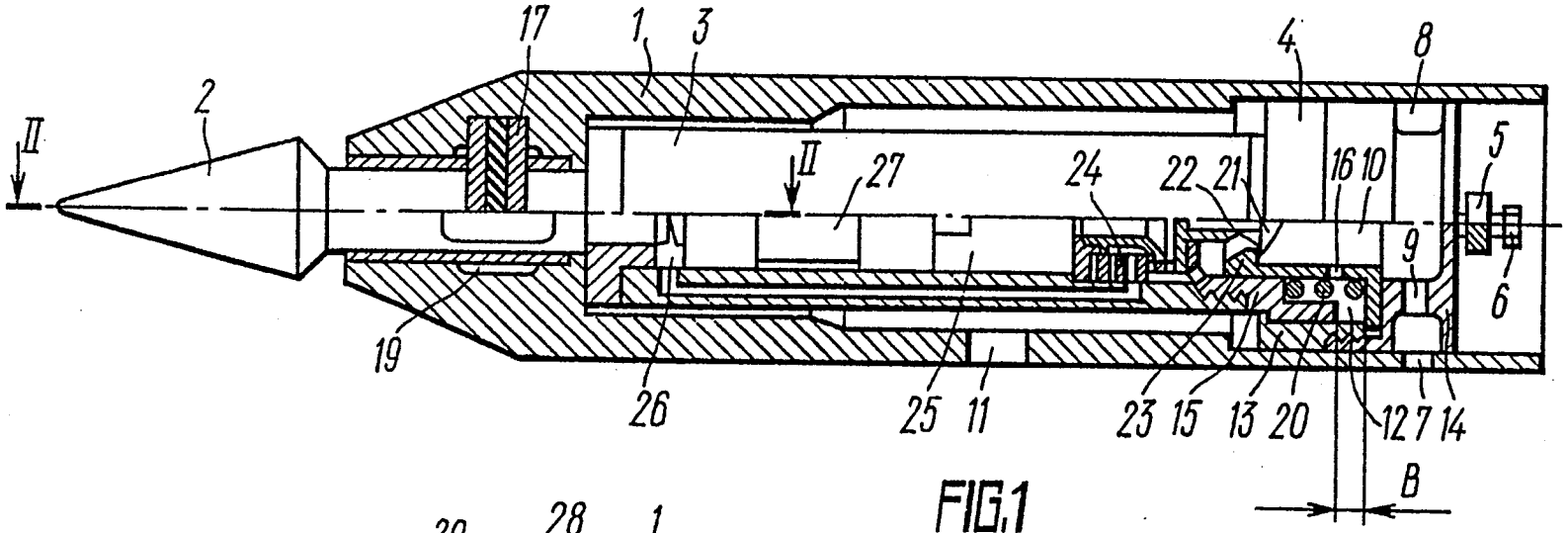
FIG. 1 is a general view, partly in section, of the tooth of an excavator bucket with a damping unit in the form of keys.

The tooth of an active-action excavator bucket comprises a hollow casing 1 (FIG. 1) accommodating an impact tool 2 and a pneumatic hammer 3 capable of moving in an axial direction, the pneumetic hammer 3 being linked with an automatic starting mechanism 4. The mechanism 4 is fixed in the casing 1 by means of a strip 5 with pressure screws 6. Working medium (compressed air) is fed to the pneumatic hammer 3 through a channel 7 in the casing, annular groove 8, radial channels 9 and a central axial channel 10. Provided on the side surface of the of the casing 1 is a port 11 for exhaust of used air. The automatic starting mechanism 4 includes a chamber 12 of a pneumatic jack formed by a housing 13, a cover 14 and a piston 15. The chamber 12 communicates with the central channel 10 through radial holes 16. The mutual motion of the pneumatic hammer 3 and the impact tool 2 relative to each other and relative to the casing 1 is limited by keys 17 performing a function of a damping unit and passing through a slot 18 (FIG. 2) made in the impact tool. An annular groove 19 (FIG. 1) is made in the casing 1.

The excavator bucket tooth of such a design operates as follows.

The chamber 12 of the pneumatic jack is permanently under pressure of compressed air in the loop, and with a low resistance to digging, the pneumatic hammer 3 and the impact tool 2 extend forward under the effect of the forces of the pneumatic jack and spring 20. The pneumatic hammer is off because the valve 21 is pressed by the air flow to the seat 22 and the impact tool operates as a static tool. As soon as the resistance to digging increases, the impact tool and the pneumatic hammer cylinder move backward together with the valve 21 for a distance "C" (their further motion is limited by the keys 17) while the sleeve 23 and, therefore, the seat 22 of the valve 21 remain in its place. The spring 20 is compressed and the compressed air from the chamber 12 of the pneumatic jack is displaced, so that an annular gap is formed between the valve and its seat. The working medium (compressed air) from the supply line (not shown) is fed through the annular groove 8, channels 9 and 10 into a pilot-valve distributor 24. From the distributor 24 the compressed air is alternately directed to a forward stroke chamber 25 and a backward stroke chamber 26 of the pneumatic hammer 3. In so doing, a striker 27 reciprocates and strikes the tail of the impact tool 2 moving it forward. Impact breaking of the rock occurs. The used air is released into the atmosphere through the exhaust ports 11.

When the resistance to digging offered to the impact tool drops below the force of the spring and pneumatic jack, the pneumatic hammer and impact tool return to the initial position while the valve 21 is closed and the pneumatic hammer 3 is switched off. At the initial moment of reduction of the resistance to digging, the impact tool 2 is acted on by the dynamic loads from the striker 27 of the pneumatic hammer 3 which moves by inertia. The length of the through slot 18 for free passage of the keys 17 is defined by the relation: $L=B-x-c+2l+b$, where L is the length of the key slot 18; B is the gap between the housing 13 and the piston 15 of the automatic starting mechanism 4 when the pneumatic hammer 3 is off; l is the length of penetration of the tool 2 into rock per stroke; C is the value of the tool stroke 2 per stroke; x is the minimum permissible gap between the housing 13 and the piston 15 of the automatic starting mechanism 4; b is the width of the key 17.

The keys limit the axial motion of the impact tool forward for a value "L−c−b" to exclude a possibility of its overhang at this moment. This is provided by making each key in the form of two rigid members 28 separated by an elastic insert 29 which damps a part of the impact energy due to elastic deformation protecting the rigid members of the keys against breakage. The elastic insert 29 decreases the loads at the point of contact of the keys with the casing reducing a possibility of plastic deformation of the casing material in the case of drastic reduction of the resistance of the rock to digging. The groove 19, in turn, prevents formation of swelling of metal near the key slot 18.

The structural features described above make it possible to simplify the assembly of the device, as well as replacement of worn parts, e.g., the impact tool, since in this case it is sufficient to remove the keys 17 to provide free removal of the tooth.

Figure 3:
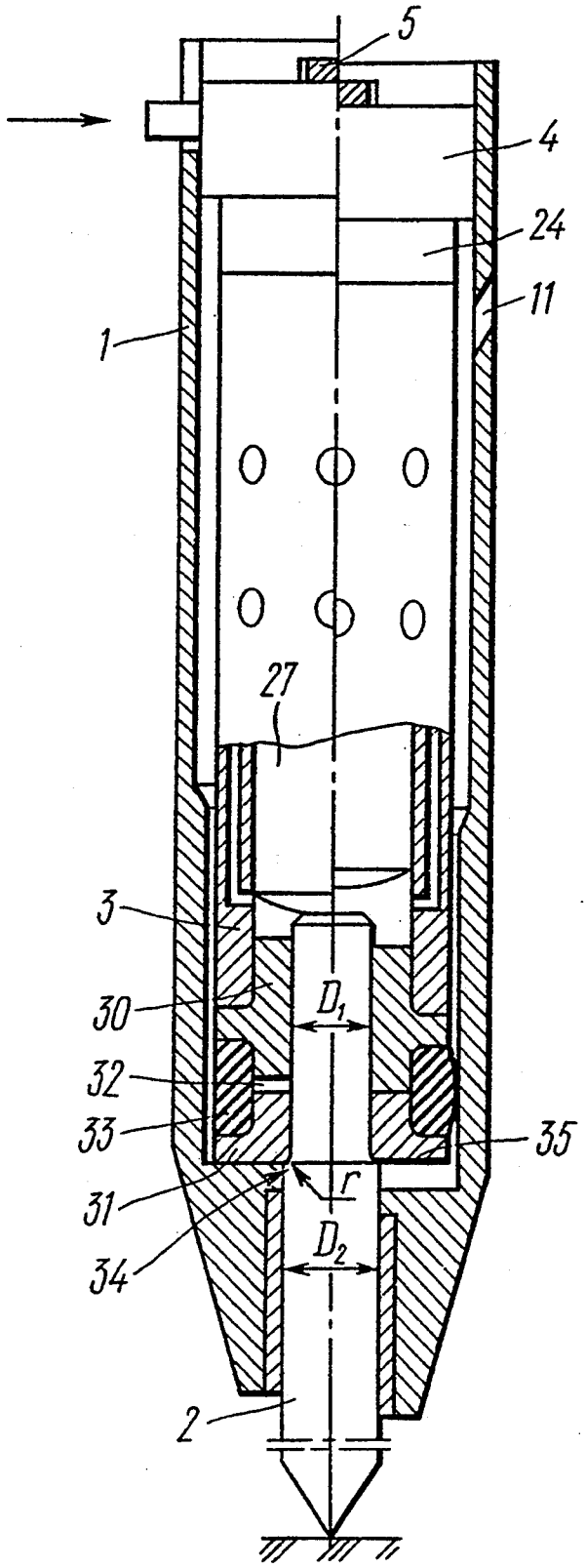
FIG. 3 is the same as FIG. 1 but with a damping unit in the form of a bushing.

Shown in FIG. 3 is another embodiment of the excavator bucket tooth, in which the damping unit is made in the form of a bushing having an upper part 30 and a lower part 31 installed with an axial gap 32. The parts 30 and 31 are interconnected by means of an elastic member 33.

The drawing (FIG. 3) shows the device in two positions: in the initial position (to the left); the position after the pressure force has been applied and the device is put into operation (to the right).

Figure 2:
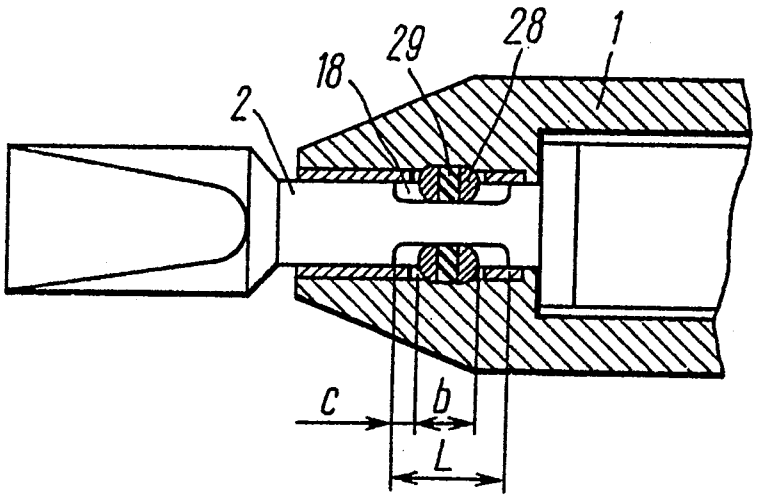
FIG. 2 is a sectional view taken along line II—II in FIG. 1.

When an axial force is applied to the casing 1 downwards, the impact tool 2 rests against rock and acts through the bushing on the stem of the pneumatic hammer 3 providing its motion relative to the automatic starting mechanism 4. At this moment the mechanism 4 is in close contact with the strip 5 and moves downward together with the casing (the right-hand part of FIG. 8). The pneumatic hammer is put into operation by feeding compressed air through a line (not shown) to an air distributor 24 (FIG. 1). After the pneumatic hammer has been started, its striker 27 strikes the tail of the tool 2 and breaks the rock. If in the process of operation cavities are formed in the rock in front of the impact tool, the latter moves forward drastically and the unconsumed kinetic energy of the striker is resisted by the parts 30 and 31 of the bushing. After the bushing has received an impact from the striker 27 and before its contact with the casing 1, the parts 30 and 31 of the bushing collide. In this case, the impact energy is extinguished when an impact impulse is transmitted from one part of the bushing to the other, while the recoil is smoothed out by the elastic member 33. When the bushing approaches the casing, the impact momentum is much weaker. The casing 1 has a flange 34 and during the collision of the bushing with the casing the impact load is resisted primarily by the cylindrical portion of the bushing resting on the casing with the cylindrical portion 35 of the bushing. The inner diameter $D_2$ of the flange 34 of the casing is defined by the relation $D_1+2r$, where $D_1$ is the inner diameter of the bushing and r is the radius of joining of the inner diameter of the bushing with its end face 35. Owing to such a design of the casing, the bending moment is considerably reduced and additionally equalized by the elastic member 33 deforming due to the application of the load. Thus, the load is uniformly distributed over the entire bushing surface.

Then the impact tool 2 thrusts against the unbroken rock, is decelerated and stops. However, the excavator continues to operate with its bucket and the casing is displaced relative to the impact tool. The latter again acts on the cylinder of the pneumatic hammer 3 through the bushing and provides conditions to continue the operation or restart of the pneumatic hammer, if the mechanism 4 is cut off from compressed air supply. When the load on the tool disappears, for example, when the bucket is removed from the face, the mechanism 4 switches off the power supply of the pneumatic hammer 3.

The present invention allows one to increase the reliability and, consequently, operational longevity when developing hard rock and frozen ground. The design features of the invention considerably simplify the device and provide convenient service. The proposed layout of the units and elements of the device provides the most uniform distribution of the impact loads.

We claim:

1. A tooth of an active-action excavator bucket comprising:

a hollow casing, an impact tool mounted inside said casing with a possibility of axial motion, a pneumatic hammer installed inside said casing with a possibility of axial motion, an automatic starting mechanism connected to said pneumatic hammer, a housing with a piston incorporated into said automatic starting mechanism of said pneumatic hammer, and a damping means arranged between said casing, impact tool and elements of the pneumatic hammer for providing damping therebetween, said damping means comprising a damping unit comprising two rigid bodies spaced apart in the direction of axial motion of the impact tool and located to respectively receive impact force in opposite directions of travel of said tool to limit said travel, and an elastic member sandwiched between said rigid bodies, said rigid bodies facing respective contact surfaces of said tool for contacting said surfaces and receiving impact forces therefrom during opposite directions of travel of said impact tool, said elastic member absorbing the impact forces applied to said rigid bodies during travel of said tool in said opposite directions.

2. a tooth according to claim 1, in which the rigid bodies of said damping unit comprise keys limiting the mutual displacement of the pneumatic hammer and the impact tool relative to each other and relative to the casing, said tool having a through slot in which the keys are movable.

3. A tooth according to claim 2, in which the length of the key slot is selected from the relation:

$$L=B-x-c+2l+b.$$

where

L is the key slot length;

B is the gap between the housing and the piston of the automatic starting mechanism when the pneumatic hammer is off;

l is the length of penetration of the tool into rock per stroke;

c is the distance passed by the tool per stroke;

x is the minimum permissible gap between the housing and the piston of the automatic starting mechanism;

b is the key width.

4. A tooth according to claim 2, in which each key is made of two rigid members with an elastic member arranged therebetween.

5. A tooth according to claim 2, in which an annular groove is made in the casing near the key slot.

6. A tooth according to claim 1, in which the damping unit is in the form of a bushing consisting of said two rigid bodies installed with an axial gap and interconnected by means of said elastic member.

7. A tooth according to claim 6, in which the casing has a flange facing one of said rigid bodies.

8. A tooth according to claim 7, in which the inner diameter of the flange of the casing is determined from the relation $D_1 + 2r$, where:

$D_1$ is an inner diameter of the rigid bodies; and r is a radius joining the inner diameter of the rigid bodies with an end face of that one of the bodies facing said casing.

9. A tooth according to claim 7, wherein one of said contact surfaces is provided on said casing and the other of said contact surfaces is provided on said impact hammer.

10. A tooth according to claim 1, wherein said contact surfaces are provided at opposite ends of a through slot in said impact tool.

* * * * *